United States Patent [19]

Schaller et al.

[11] Patent Number: 4,833,578

[45] Date of Patent: May 23, 1989

[54] OPTICAL SYSTEM FOR GENERATING MULTIPLE LIGHT BEAMS FROM A SINGLE SOURCE

[75] Inventors: David R. Schaller, Janesville; Judy D. Pyle, Madison, both of Wis.

[73] Assignee: Rayovac Corporation, Madison, Wis.

[21] Appl. No.: 227,483

[22] Filed: Aug. 1, 1988

Related U.S. Application Data

[63] Continuation of Ser. No. 88,583, Aug. 24, 1987, abandoned.

[51] Int. Cl.[4] ..... P21V 7/02

[52] U.S. Cl. ..... 362/296; 362/297; 362/304

[58] Field of Search ..... 362/297, 304, 296, 301, 362/309, 346, 305, 247

[56] References Cited

U.S. PATENT DOCUMENTS

| | | | |
|---|---|---|---|
| 1,147,344 | 7/1915 | Spear | 362/297 |
| 2,408,643 | 10/1946 | Hoy | 362/197 |
| 2,951,948 | 9/1960 | Adams et al. | 362/296 |
| 4,112,483 | 9/1978 | Small, Jr. et al. | 362/301 |
| 4,174,533 | 11/1979 | Barthes et al. | 362/346 |
| 4,409,646 | 10/1983 | Baliozian | 362/346 |
| 4,441,141 | 4/1984 | Lo | 362/309 |
| 4,544,999 | 10/1985 | Kawanami et al. | 362/304 |
| 4,564,892 | 1/1986 | Oram | 362/297 |

*Primary Examiner*—Raymond A. Neill
*Attorney, Agent, or Firm*—Kenyon & Kenyon

[57] ABSTRACT

An optical system is disclosed for generating multiple light beams from a single light source. The system includes reflectors disposed adjacent to the optical axis of the light source to capture and reflect all the light in a space efficient manner. One of the beams may be collimated for spot lighting while the others may be wide-angled. Alternatively all the beams may be collimated.

19 Claims, 2 Drawing Sheets

OPTICAL SYSTEM FOR GENERATING MULTIPLE LIGHT BEAMS FROM A SINGLE SOURCE

This is a continuation application to application Ser. No. 088,583, filed Aug. 24, 1987, now abandoned.

RELATED APPLICATION

The subject matter of this application is related to the following commonly assigned applications Ser. No. 088,582 filed Aug. 24, 1987 entitled Device with Composite Reflector; Ser. No. 088,679 filed Aug. 24, 1987 entitled A Flashlight with Space Efficient Reflector.

BACKGROUND OF THE INVENTION

1. Field of Invention

This invention pertains to an optical system for generating at least two light beams from a single light source. One light beam may be collimated for spot illumination, or both beams may be collimated. The system is particularly useful in flashlights because its low space requirements.

2. Description of the Prior Art

It is often advantageous to generate two or more light beams from a single light source along several axes. The beams may be used to illuminate different objects simultaneously. Alternatively one beam may be used to provide general or flood-type illumination while a second beam may be needed for concentrated or spot-type illumination. Several optical systems have been proposed in the past which can produce light beams from a single source however all them have various disadvantages as discussed more fully below.

In U.S. Pat. No. 2,408,643 a flashlight is disclosed with a head for projecting two light beams in opposite directions. The head includes two separate light bulbs with individual reflectors.

In U.S. Pat. Nos. 4,174,533 and 4,564,892 devices are disclosed which generate two beams which are directed toward the same area such as the mouth of a patient. The devices make use of paraboloidal reflectors to generate identical divergent beams directed towards a common area. These devices are used in the field of dentistry. In U.S. Pat. No. 1,147,344 a vehicle lamp is used with a reflector which is paraboloidal but generates only a single light beam.

OBJECTIVES AND SUMMARY OF THE INVENTION

In view of the above mentioned disadvantages of the prior art, it is an objective of the present invention to provide an optical system for generating multiple light beams from a single source, each beam capable of being shaped independently of the other for particular lighting requirements.

Another objective is to provide a system which requires a relatively small space so that it can be used in small devices such as hand-held flashlights. A further objective is to provide a system which makes optimal or nearly optimal use of the light generated by the light source. Other objectives and advantages of the invention shall become apparent from the following description of the invention.

Briefly an optical system constructed in accordance with the present invention includes a light source and two reflectors. At least one of the reflectors is hemiparaboloidal and is disposed so that its axis intersects the optical axis of the light source. In this manner the light generated by the source is collected and reflected more efficiently.

DETAILED DESCRIPTION OF THE INVENTION

Figure 1:
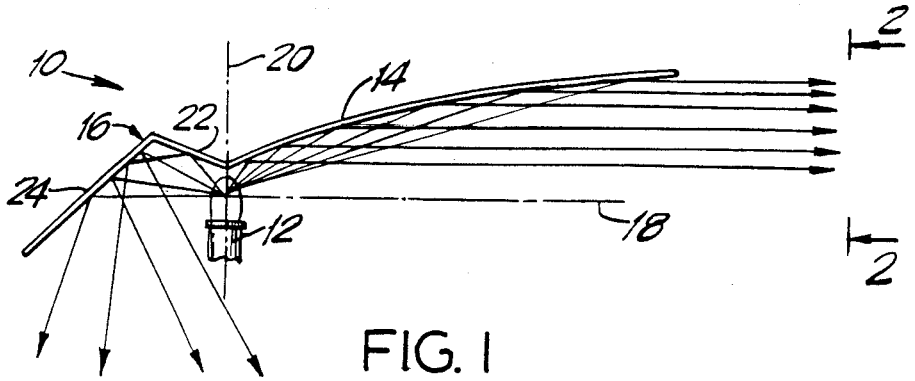
FIG. 1 shows a side view of an optical system constructed in accordance with this invention for generating a collimated and a divergent or wide beam, directed at different angles.
Figure 2:
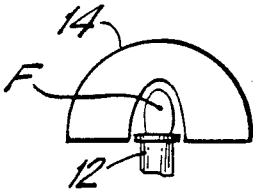
FIG. 2 shows a side view of the embodiment of FIG. 1.

Referring now to FIGS. 1 and 2, an optical system 10 in accordance with this invention comprises a light source 12, a first reflector 14 and a second reflector 16. The first reflector 14 has the shape of a truncated hemiparaboloid with a reflector axis 18, and a focal point F which preferably coincides with the center of light source 12 to produce a collimated light beam along axis 18 as shown.

Advantageously the light source is oriented with its optical axis 20 traversing the optical axis 18 of reflector 16.

Figure 3:
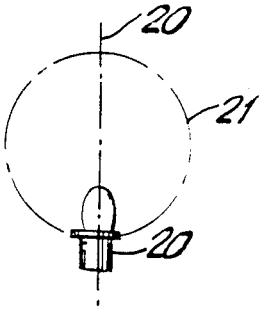
FIG. 3 shows a typical light pattern generated by many light sources.

Preferably these two axes are perpendicualr to each other. As shown in FIG. 3, many light sources generate an approximately spherical light pattern 21 disposed in front of the source on its optical axis 20 and virtually no light along axis 20 in the direction opposite reflector 14 and therefore the reflectors and the source are positioned adjacent to the source optical axis for optimal collection and reflection of the light from the light source. The light source 12 may be an incandescent bulb, a light emitting diode, a specially shaped fluorescent element, or any other similar device.

Reflector 16 is composed of two sections 22 and 24. Both sections are planar mirrors and they cooperate to produce a wide angle beam as shown. It should be appreciated that the collimated beam produced by the reflector 14 is directed at a different angle than the wide angle beam produced by reflector 16.

Figure 4:
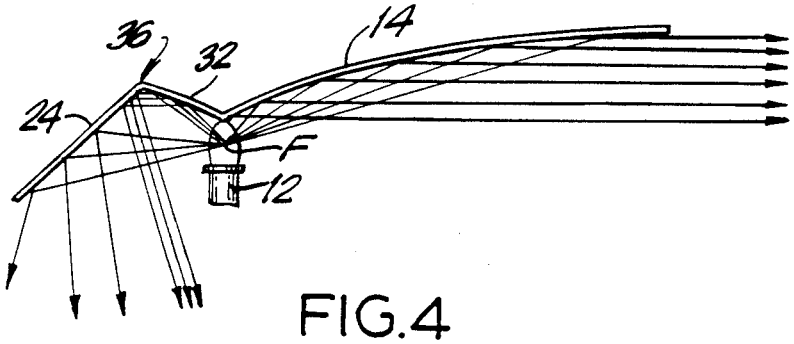
FIG. 4 shows a side view of a second embodiment of the invention wherein the divergent beam is a moderately wide angle beam.

The embodiment of FIG. 4 is very similar to the embodiment of FIG. 1 except that reflector 16 is replaced by a reflector 36. This reflector 36 is composed of a curved section 32 and a planar mirror 24. Preferably section 32 is also a truncated hemiparaboloid having a focal point which coincides with the focal point F of reflector 14. The two reflector sections 24 and 32 cooperate to generate a beam which is still divergent but is at a relatively narrower angle than the beam produced by the first embodiment. The two beams are still directed along different directions.

Figure 5:
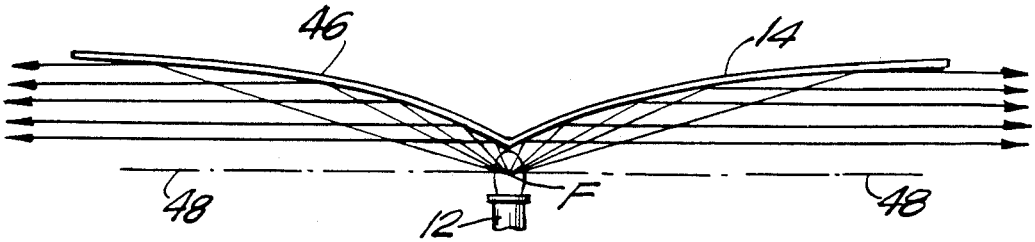
FIG. 5 shows a side view of a third embodiment for generating two collimated beams directed in opposite directions.

In the embodiment of FIG. 5 the second reflector 46 is also a truncated hemiparaboloid. The two reflectors have a common reflector optical axis 48 and a common focal point F. The beams generated by the reflectors are both collimated and directed in opposite directions.

Figure 6:
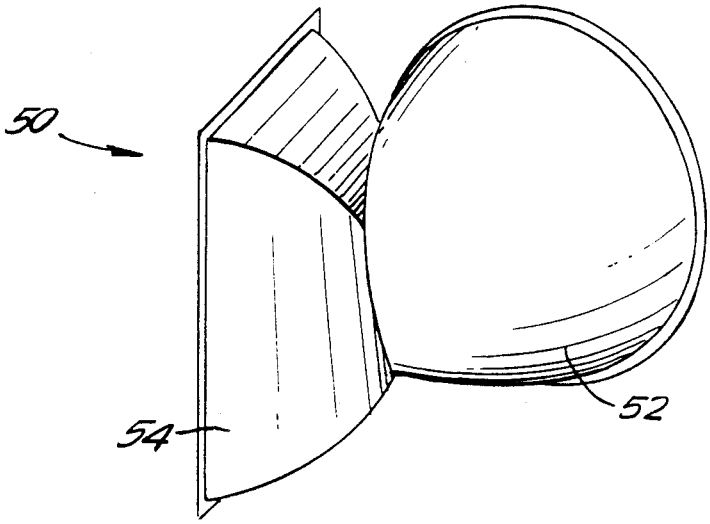
FIG. 6 shows a perspective view of a complete reflector assembly incorporating the optical system of FIG. 1.

A reflector assembly 50 incorporating an optical system described above is shown in FIGS. 6 and 7. The assembly includes a section 52 which houses a first reflector and a generally rectangular section 54 which houses a second reflector. Preferably the reflector in section 52 is concentrated so that it can be used for spot lighting. For this purpose, the reflector may be similar to reflector 14 of FIG. 1.

Figure 7:
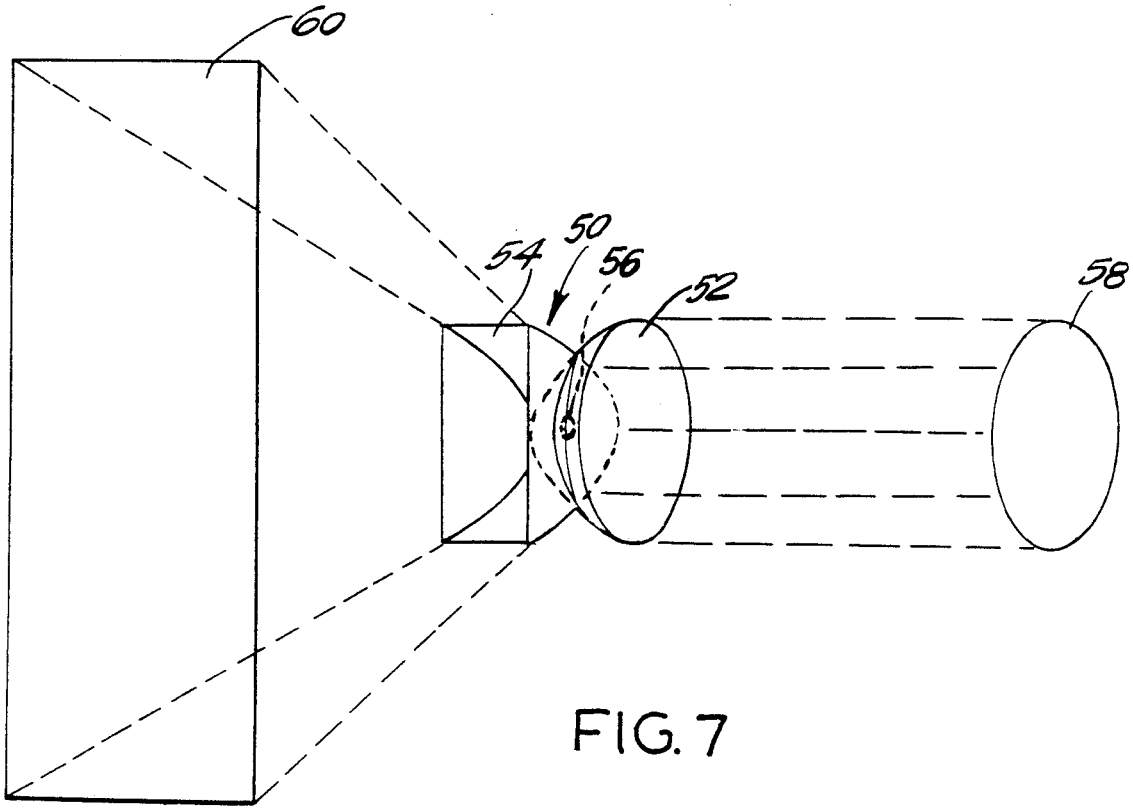
FIG. 7 shows the light beams generated by the reflector assembly of FIG. 6.

The reflector in FIG. 1 being semiparaboloidic generates a somewhat D-shaped beam. However the reflector may also have a paraboloidal surface with longitudinal axis 18, in which case a circular beam 58 can be obtained as shown in FIG. 7.

The reflector in Section 54 preferably generates a somewhat difused beam 60 which is more suitable for flood-lighting. Between the two sections 52, 54 an aperture 56 may be made through which the light bulb 12 may be inserted.

Obviously numerous modifications may be made to the invention without departing from its scope as defined in the appended claims.

We claim:

1. An optical system for generating several light beams comprising:

a light source generating light in a polar pattern along a source optical axis; and at least two reflectors positioned adjacent to said source optical axis and having reflector axes disposed at an angle with respect to said source optical axis for generating at least two corresponding light beams along said reflector axes, said reflectors further having apexes which contact each other, said reflectors extending in opposite directions from said apexes.

2. The optical system of claim 1 wherein one of said beam is a collimated beam and a second beam is a wide angle beam.

3. The optical system of claim 1 wherein said beams are collimated beams.

4. The optical system of claim 1 wherein at least one of said reflectors is formed by rotating a first generatrix around a longitudinal axis to form a first three dimensional solid and sectioning said solid with a plane substantially parallel to said longitudinal axis, said one reflector being positioned with said longitudinal axis in perpendicular to said source optical axis.

5. The optical system of claim 4 further comprising a second reflector formed by rotating a second generatrix around said longitudinal axis to form a second three dimensional solid and sectioning said solid with a second plane in parallel with said longitudinal axis from said apexes.

6. An optical system for generating two light beams comprising:

a light source generating light in a light pattern projected along a source optical axis, said light source having a center;

a first reflector positioned adjacent said source optical axis and having a first reflector optical axis traversing said source optical axis for generating a collimated light beam; and a second reflector positioned adjacent said source optical axis and said first reflector for generating a second light beam; said first and second reflectors having a common focal point coinciding with said center, said beams being reflected in opposite directions.

7. The optical system of claim 6 wherein said second reflector comprises a first planar mirror and a second planar mirror for generating said second beam said second beam having a wide angle.

8. The optical system of claim 6 wherein said second reflector comprises a planar mirror and a curved section for diverging said second beam, said second beam having a wide angle.

9. The optical system of claim 8 wherein said second beam is projected at an angle with respect to said first beam.

10. The optical system of claim 6 wherein said first mirror is truncated hemiparaboloid.

11. The optical system of claim 6 wherein said second reflector is curved.

12. The optical system of claim 11 wherein said second reflector is a truncated hemiparaboloid.

13. The optical system of claim 6 wherein said first and second reflectors are truncated hemiparaboloid with a common focal point.

14. The optical system of claim 6 wherein said first and second reflectors are in contact at a point disposed on said source optical axis.

15. An optical system for generating two light beams comprising:

a light source having a center, said light source generating a light pattern projected along a source optical axis;

a first reflector positioned adjacent said source optical axis and having a first reflector optical axis traversing said source optical axis for generating a collimated beam;

a second reflector positioned adjacent said source optical axis and said first reflector for generating a non-collimated light beam, said collimated and non-collimated light beams being directed in different directions, said second reflector including a flat mirror.

16. The optical system of claim 7 wherein said second beam is projected at an angle with respect to said first beam.

17. An optical system for generating light beams in different directions comprising:

a light source generating a light pattern projected along a source optical axis; and first and second reflectors extending from said optical axis to generate first and second beams in corresponding first and second directions intersecting said source optical axis, at least one of said first and second beams being a collimated beam.

18. The system of claim 17, wherein said first reflector includes a mirror for generating a wide angle beam.

19. The sytem of claim 18, wherein said light source has a center and said second reflector has a focal point corresponding to said center.

* * * * *

UNITED STATES PATENT AND TRADEMARK OFFICE

CERTIFICATE OF CORRECTION

PATENT NO. : 4,833,578

DATED : 23 May 1989

INVENTOR(S) : Judy D. PYLE and David R. SCHALLER

It is certified that error appears in the above-identified patent and that said Letters Patent is hereby corrected as shown below:

TITLE PAGE:

In the title, before "OPTICAL" insert --UNIQUE--.

| Column | Line | |
|---|---|---|
| 1 | 22 | After "because" insert --of--. |
| 2 | 39 | Change "perpendicualr" to --perpendicular--. |
| 3 | 40 | Change "beam" (first occurrence) to --beams--. |
| 4 | 11 | After "beam" insert --,--. |
| 4 | 27 | Change "hemiparaboloid" to --hemiparaboloids-- |

Signed and Sealed this

Twenty-ninth Day of October, 1991

*Attest:*

HARRY F. MANBECK, JR.

*Attesting Officer*

*Commissioner of Patents and Trademarks*